US007329219B2

(12) United States Patent
Blanchard et al.

(10) Patent No.: US 7,329,219 B2
(45) Date of Patent: Feb. 12, 2008

(54) FOLDING APPARATUS IN A WEB-FED ROTARY PRINTING PRESS

(75) Inventors: Alain Blanchard, Gouvieux (FR); Jean-Francois Robert, Creil (FR)

(73) Assignee: Goss International Americas, Inc., Dover, NH (US)

( * ) Notice: Subject to any disclaimer, the term of this patent is extended or adjusted under 35 U.S.C. 154(b) by 710 days.

(21) Appl. No.: 10/437,576

(22) Filed: May 14, 2003

(65) Prior Publication Data

US 2004/0058793 A1 Mar. 25, 2004

(30) Foreign Application Priority Data

May 15, 2002 (DE) ..... 102 21 794

(51) Int. Cl.
*B31B 1/16* (2006.01)

(52) U.S. Cl. ..... 493/365; 493/324; 493/364; 493/370

(58) Field of Classification Search ..... 493/324, 493/340, 364, 365, 370
See application file for complete search history.

(56) References Cited

U.S. PATENT DOCUMENTS

| | | | | |
|---|---|---|---|---|
| 2,538,425 | A * | 1/1951 | Nolan | 83/110 |
| 3,300,365 | A * | 1/1967 | Roos | 156/361 |
| 3,859,879 | A | 1/1975 | Spengler | 83/155 |
| 4,432,746 | A * | 2/1984 | DeHaan | 493/359 |
| 4,957,280 | A | 9/1990 | Motooka | 270/47 |
| 4,983,155 | A * | 1/1991 | Stobb | 493/369 |
| 5,103,703 | A * | 4/1992 | Littleton | 83/155 |
| 5,230,268 | A * | 7/1993 | Richter | 83/303 |
| 5,484,379 | A | 1/1996 | Staeb | 493/359 |
| 5,839,365 | A | 11/1998 | Calbrix et al. | 101/226 |
| 6,280,373 | B1 | 8/2001 | Lanvin | 493/227 |
| 6,604,444 | B1 | 8/2003 | Belanger et al. | 83/155 |
| 6,722,243 | B2 * | 4/2004 | Adami | 83/508.1 |

FOREIGN PATENT DOCUMENTS

| | | |
|---|---|---|
| DE | 1160300 | 12/1963 |
| DE | 81074 | 4/1971 |
| DE | 2225007 | 11/1973 |
| DE | 3605085 | 8/1987 |
| DE | 3900663 | 7/1989 |
| DE | 4120629 | 12/1992 |
| DE | 19949223 | 5/2000 |
| EP | 0820949 | 1/1998 |
| GB | 997683 | 7/1965 |
| GB | 1388217 | 3/1975 |
| GB | 2256829 | 12/1992 |

* cited by examiner

*Primary Examiner*—Christopher Harmon
(74) *Attorney, Agent, or Firm*—Davidson, Davidson & Kappel, LLC

(57) ABSTRACT

A folding apparatus (1) in a web-fed rotary printing press for folding signatures (2) which are cut off from a running web of material (6) by a cutting device (40) and carried on a signature transport surface (10) of a folding blade cylinder with the aid of at least one rotating band-shaped conveying element (12, 22, 36, 38) has the feature that the cutting device (4) includes a cutting blade (14) arranged on the folding blade cylinder (8) as well as a rotating anvil element (16) which interacts with the cutting blade; the band-shaped conveying element (12, 22, 36, 38) being passed around the rotating anvil element (16) in such a manner that the band-shaped conveying element acts as a supporting element for the cutting blade (14) during the cutting of the signatures (2).

6 Claims, 10 Drawing Sheets

FOLDING APPARATUS IN A WEB-FED ROTARY PRINTING PRESS

Priority to German Patent Application No. 102 21 794.7, filed May 15, 2002 and hereby incorporated by reference herein, is claimed.

BACKGROUND INFORMATION

The present invention relates to a folding apparatus in a web-fed rotary printing press.

In web-fed rotary printing presses, the material webs to be printed are pulled off a paper roll and, upon printing in one or more printing units, are fed to a folding apparatus in which the webs are cut into individual signatures by a cutting device and subsequently folded crosswise by a folding blade arranged on a folding blade cylinder.

In this context, it is necessary for the signatures to be always guided in a controlled manner during the cutting process and the subsequent transport to and/or on the folding blade cylinder or on a transfer cylinder of the folding apparatus to ensure that the leading edges of the signatures are not folded over and that the folds are located exactly at the intended positions.

In this context, it is known from U.S. Pat. No. 5,484,379 to arrange a first cutting cylinder before a folding blade cylinder, the cutting cylinder having a segmented cutting blade which is provided with gaps and which makes a plurality of spaced apart first partial cuts in the material web. In the process, the signatures are carried by endlessly rotating conveyer belts during the cutting operation and during the subsequent transport to and on the folding blade cylinder, the conveyer belts passing through the gaps and partially wrapping around the downstream folding blade cylinder. In a second cutting operation, a further cutting cylinder, which similarly carries a cutting blade provided with further gaps, makes second partial cuts in the web, which complement the first partial cuts into a continuous cut. In this process, the signatures are similarly carried by a plurality of further conveyer belts passing through the further gaps in the second cutting blade; the folding blade cylinder serving as a supporting element or anvil element for the second cutting blade. Apart from the large number of component parts, the first and second partial cuts made in the material web lead to the problem that the cut edges of the signatures are not smooth along the entire length, even in the case of minor changes in position of the signatures after the first cutting operation, and therefore generally require post-processing.

BRIEF SUMMARY OF THE INVENTION

Accordingly, an object of the present invention is to provide a folding apparatus in a web-fed rotary printing press which allows the signatures to be guided in a controlled manner during the cutting process and during transport through the folding apparatus with a reduced number of component parts.

According to the present invention, a folding apparatus for folding signatures which are cut off by a cutting device from a running web of material that is printed in a web-fed rotary printing press, includes a cylinder, in particular, a folding blade cylinder or transfer cylinder or collecting cylinder, on whose peripheral surface, hereinafter referred to as signature transport surface, the signatures are conveyed by at least one rotating band-shaped conveying element. In this context, according to the present invention, the cutting device has a cutting blade which is arranged on the folding blade cylinder and which interacts with revolving a or rotating anvil element, preferably in the form of a cutting-blade cylinder. The rotating band-shaped conveying element is passed around the rotating anvil element in such a manner that the band-shaped conveying element acts as a supporting element or counter-pressure element for the cutting blade during the cutting of the signatures.

In this context, the rotating band-shaped conveying element can be passed around the rotating anvil element, for example, directly on and in contact with the peripheral surface of the rotating anvil element.

However, it is equally possible for the rotating band-shaped conveying element to be completely or partially passed around the periphery of the anvil element and additionally over deflection pulleys. In this context, it has turned out to be particularly advantageous if the deflection pulleys are arranged in such a way that, with respect to the rotation center of the folding blade cylinder, the rotating band-shaped conveying element is guided on and in contact with the perimeter of the folding blade cylinder over an angular range of about 5° to 40° before the point of interaction of the cutting blade and the anvil element, and if the material web is held between the peripheral surface of the folding blade cylinder and the conveying element over this range, as it were, in a sandwich-like manner, prior to the cutting operation. This leads to a considerable reduction of the web vibrations that are produced by the cutting operation.

Equally, however, it can be provided that the material web runs substantially tangentially between the anvil element and the folding blade cylinder.

The present invention leads to the advantage that the signatures can be reliably guided even at very high speeds without the leading edges of the signatures being disadvantageously folded over after the cutting operation due to the arising relative wind, resulting in a paper jam or even damage to the folding apparatus. Moreover, the present invention has the advantage that, using a cutting device having a cutting blade which extends over the entire width of the material web, the cut edges of the signatures are straight and smooth by nature and, unlike in the prior art devices in which a first and a second partial cut are made one after the other, do not have any steps, which occur, for example, when the signatures are not accurately guided by the conveyer belts, for example, due to vibrations.

In the preferred embodiment of the present invention, the band-shaped conveying element is designed as a belt which is preferably guided in a groove formed on the rotating anvil element, the depth of the groove being slightly smaller than the thickness of the belt. Although, in this context, it is preferred not to use a single belt, but a plurality of belts that are arranged in known manner side-by-side at a distance from each other, the present invention will be explained below with the example of a single belt for the sake of simplification.

According to a first embodiment of the present invention, the belt is designed as a toothed belt which, in the regions where the cutting blade interacts with it during the cutting operation, is provided with reinforced sections or inserts, for example, of metal or of Kevlar, onto which the cutting blade is pressed during the cutting operation to cut the web located therebetween. This results in the advantage that the inner structure, in particular, the longitudinal strands for receiving the tensile forces within the belt, can be retained if the reinforced sections are only arranged on the smooth-surfaced upper side of the toothed belt, thus making it possible to use an inexpensive conventional toothed belt requiring only comparatively slight structural modifications.

In this context, the reinforced sections are preferably spaced apart by a distance which corresponds to the respective signature cut-off and which, in the case of slippage between the toothed belt and the peripheral surface of the folding blade cylinder, is increased by a value which corresponds to the width of the gap that forms between the leading edge of the material web or of a following signature and the trailing edge of a preceding signature due to slippage in the course of the rotation of the folding blade cylinder.

In the preferred embodiment of the present invention, the reinforced sections are each preferably provided with a cutting groove into which the associated cutting blade of the cutting blade cylinder plunges during the cutting operation. Providing the reinforced sections of the toothed belt with an additional groove leads to the advantage that the cut edges of the signature are formed in a very precise and smooth manner, even in the case of multilayer signatures.

Moreover, the toothed belt is passed around the rotating anvil element, which is preferably designed as a cylinder, with its toothed side and, with its flat backside, around the folding blade cylinder; the toothed belt being preferably driven by the anvil element via a toothing which is formed on the anvil element and with which engages the toothed side of the toothed belt. This results in the advantage that the toothed belt is moved with high phase stability with respect to the anvil element, making it possible to achieve very high accuracy in maintaining the cut-off register.

In the preferred embodiment of the present invention, the toothed belt or, in general, the rotating conveying element is moved at a reduced speed in relation to the signature transport surface of the folding blade cylinder. In this context, the speed is such that, as the rotation of the folding blade cylinder proceeds, a gap is formed between the cutting blade and the leading edge of the material web after the cutting operation, the gap resulting from the slippage between the signature transport surface of the folding blade cylinder and the severed signature that is moved by the toothed belt or the rotating conveying element at a lower speed.

The gap between the cutting element or the trailing edge of a preceding signature and the leading edge of the material web passed around the periphery, which forms in this manner prior to cutting off the following signature as the rotation of the folding blade cylinder proceeds, results in the advantage that the leading edge of the material web held on the peripheral surface of the folding blade cylinder by the rotating conveying element can be grasped by a leading-edge gripping device prior to cutting off the signature, the leading-edge gripping device grasping the leading edge of the material web through the gap. In this context, the leading-edge gripping device can be a known gripper device which advantageously presses and clamps the front edge or leading edge of the material web against a gripper seating running inward at an angle. In this context, the grippers are preferably closed simultaneously with or very shortly after the signature is cut off from the material web by the cutting device. In this manner, the signature is immediately brought to the circumferential speed of the folding blade cylinder upon closure of the gripper device and, during the subsequent known folding operation, held by the gripper device in known manner when the folding blade pushes the signature into the corresponding folding jaws of a downstream jaw cylinder.

Through the slippage according to the present invention between the signature and the peripheral surface of the folding blade cylinder, in the inventive device it thus is possible for the gripper devices to find enough space to move out of the peripheral surface of the folding blade cylinder and reliably grasp the leading edge of the material web.

In the preferred embodiment of the present invention, the ratio of the speeds of the transport surface of the folding blade cylinder and the speed of the rotating band-shaped conveying element corresponds to the quotient of two natural numbers so as to ensure that the cutting elements on the folding blade cylinder coincide with a reinforced section of the toothed belt again after one complete revolution of the folding blade cylinder. The same applies to the particular length of the transport surface or peripheral surface of the folding blade cylinder in relation to the length of the rotating conveying element, correspondingly. In this context, the number n assigned to the length of the transport surface can be, for example, in the range between 1 and 5 units of length and is preferably 3 units of length while the number m assigned to the length of the rotating conveying element is, for example, in the range between 1 and 3 units of length, and is preferably 1 unit of length. When speaking of "unit of length" in this context, then what is meant is, in particular, the length of the maximum processable signature size. However, the numbers and units of length can also have different values.

The cutting element can, for example, be stationarily mounted on the folding blade cylinder and protected by a protection and clamping device which is made of rubber-elastic material, for example, of polyurethane, and provided on both sides of the cutting element, and which extends beyond the tip of the cutting element in a radial direction. This offers the advantage that, during the cutting operation, the material web is automatically pressed against the anvil cylinder or against the corresponding reinforced sections of the rotating conveying element and fixed in position thereon by the protection and clamping device.

According to a further idea underlying the principle of present invention, the cutting element or cutting blade is not fixedly mounted on the folding blade cylinder, but retractable into the periphery thereof. This can be accomplished, for example, by a cam and a cam follower used in known manner for driving the folding blades, the cam being fixed to the frame and the cam follower being coupled to the cutting element so that the cam follower is actuated by the rotation of folding blade cylinder.

In a further embodiment of the present invention, downstream of the rotating band-shaped conveying element when viewed in the direction of rotation of the folding blade cylinder there is arranged a further rotating band-shaped conveying element which, when using a cutting element that is retractable into the periphery of the folding blade cylinder, can advantageously be formed of a conventional conveyer belt known from folding apparatuses, or of a plurality of conveyer belts running parallel at a distance from each other in a known manner. This results in the advantage that the further rotating conveying element can be designed in a very inexpensive way as a standard component which has been used for a long time in the manufacture of folding apparatuses, whereas, in this embodiment of the present invention, the conveying element that is passed around the anvil element is formed of a smooth-surfaced, endless belt which is composed of a material that is cut-resistant over the entire length, for example, of Kevlar or of metal, or of another cut-resistant but elastic material and which is comparatively costly to manufacture. Another advantage resulting from this can be seen in that the length of the first rotating smooth-surfaced belt formed of cut-resistant material can be selected to be comparatively short, whereas the further rotating conveying element that is formed of a conventional conveyer belt or a plurality of conventional conveyer belts can have a comparatively great length without correspondingly increasing the costs.

Moreover, the selection of a comparatively short rotating conveying element made of cut-resistant material results in the advantage that this conveying element can rotate at a variable, lower speed or at a higher speed than the peripheral surface of the folding blade cylinder so as to increase or reduce, as desired, the size of the gap that forms between the cutting device or the trailing edge of a preceding signature and the leading edge of the material web due to the difference in speed. In this embodiment of the present invention, the entire peripheral surface of the anvil element is advantageously designed as a cylindrical surface which is provided with suitable grooves for the rotating cut-resistant belt or belts and which is coated with an advantageously also rubber-elastic material, such as polyurethane, which, over the entire peripheral surface of the anvil element, serves as a cutting surface that interacts with the cutting element in the regions where the cut-resistant belts of the rotating band-shaped conveying element do not run.

BRIEF DESCRIPTION OF THE DRAWINGS

In the following, the present invention is described by way of preferred embodiments with reference to the drawings, in which:

FIG. 7 is a schematic lateral view of a further embodiment of the present invention, in which a first rotating band-shaped conveying element and a downstream, further rotating band-shaped conveying element are made use of;

DETAILED DESCRIPTION

Figure 1:
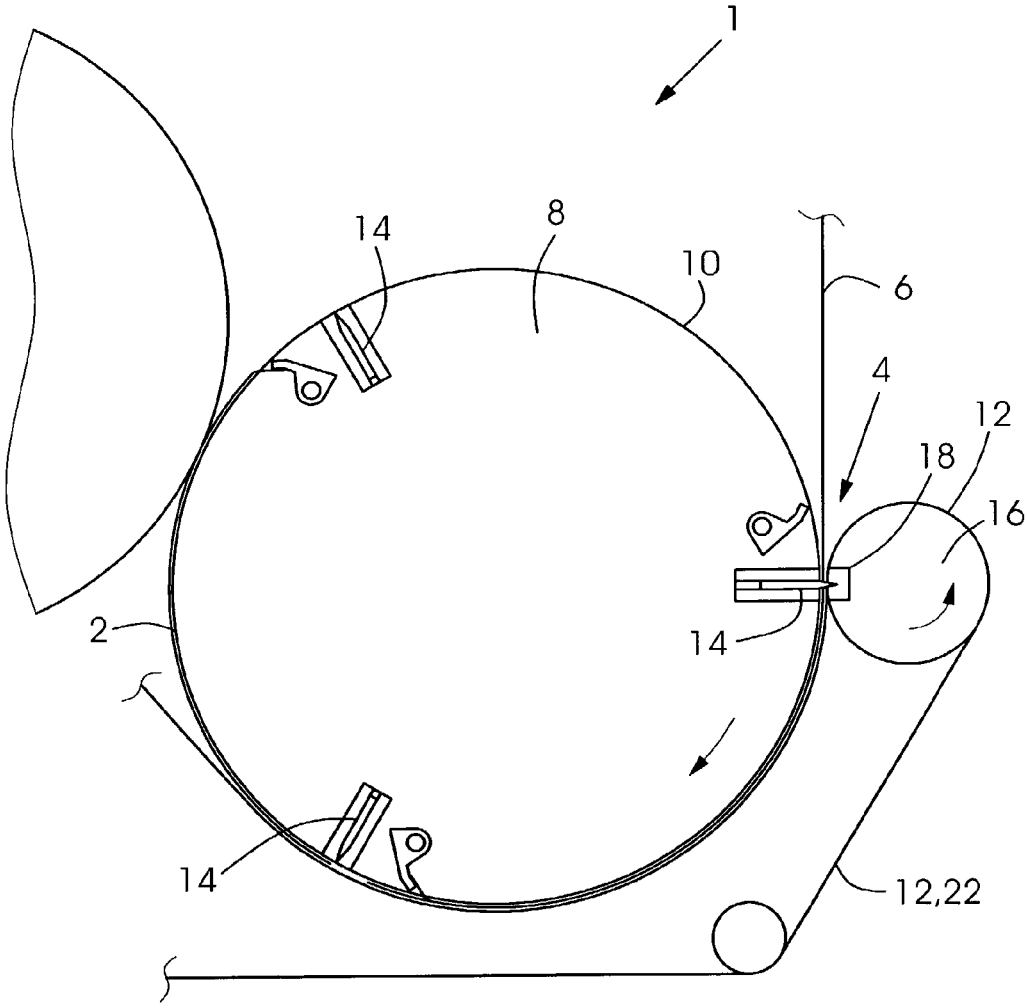
FIG. 1 is a schematic representation of a folding apparatus according to the present invention in a web-fed rotary printing press.

As shown in FIG. 1, a folding apparatus 1 according to the present invention for folding signatures 2, which are cut off from a running material web 6 by a cutting device 4, includes a folding blade cylinder 8 which has a signature transport surface 10 on which signatures 2 are guided with the aid of a rotating band-shaped conveying element 12.

In this context, cutting device 4 includes a cutting blade 14 arranged on folding blade cylinder 8 as well as a rotating anvil element 16, preferably in the form of a cylinder shown in FIG. 1, which interacts with the cutting blade 14 and around which the band-shaped conveying element 12 is passed in such a manner that, during the cutting of signatures 2, the band-shaped conveying element 12 acts as a counter-pressure element or supporting element for cutting blade 14; the counter-pressure element or supporting element, in turn, supporting itself on the corresponding location of rotating anvil element 16. In this context, support on rotating anvil element 16 can be accomplished, for example, by a grooved strip or a cutting rubber element 18 received on the anvil element, as shown in FIG. 4.

Figure 3:
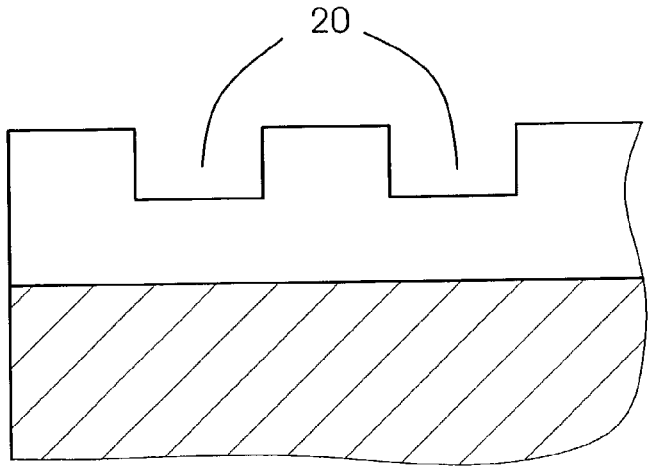
FIG. 3 shows a cross-sectional break away view of the rotating anvil element in the region of the location where the cutting element interacts with the anvil element.
Figure 4:
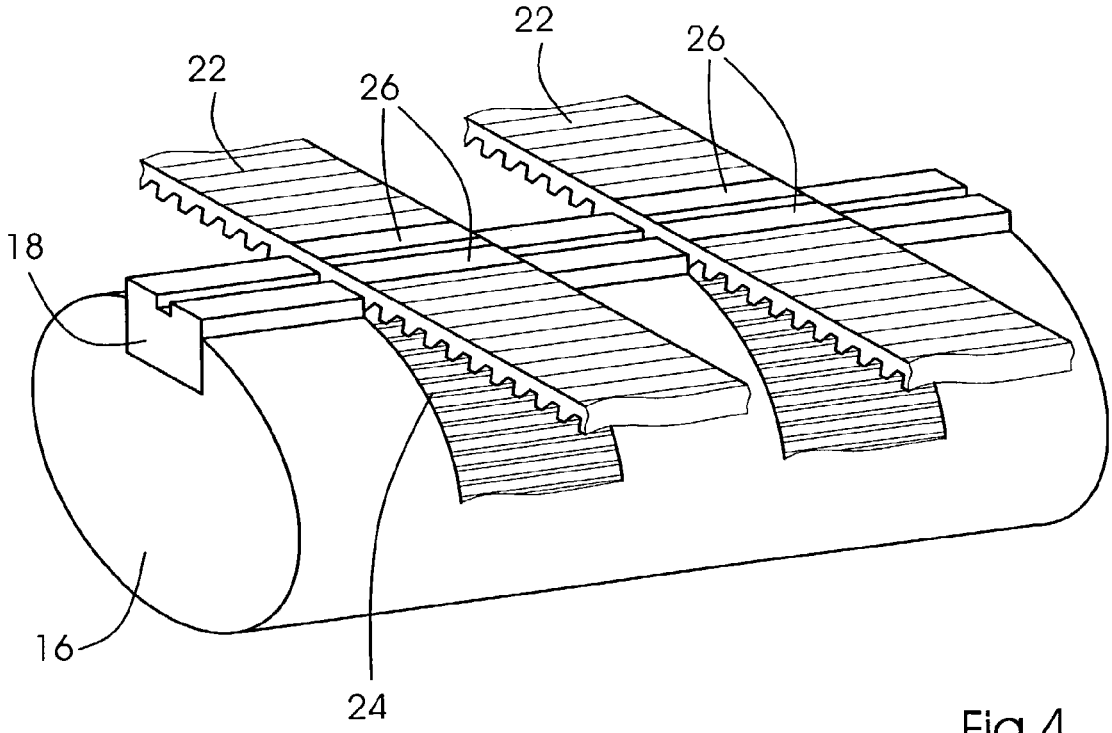
FIG. 4 is a schematic representation of the toothed belts that run through the grooves depicted in FIG. 3.

According to the representation of FIGS. 3 and 4, rotating anvil element 16 has formed therein at least one groove 20 in which rotating band-shaped conveying element 12 is guided; the depth of groove 20 being slightly smaller than the thickness of band-shaped conveying element 12. When, according to the preferred embodiment of the present invention, a plurality of parallel, rotating band-shaped conveying elements 12 lying side-by-side are used, a corresponding number of correspondingly spaced grooves 20 are arranged over the width of rotating anvil element 16.

Figure 2A:
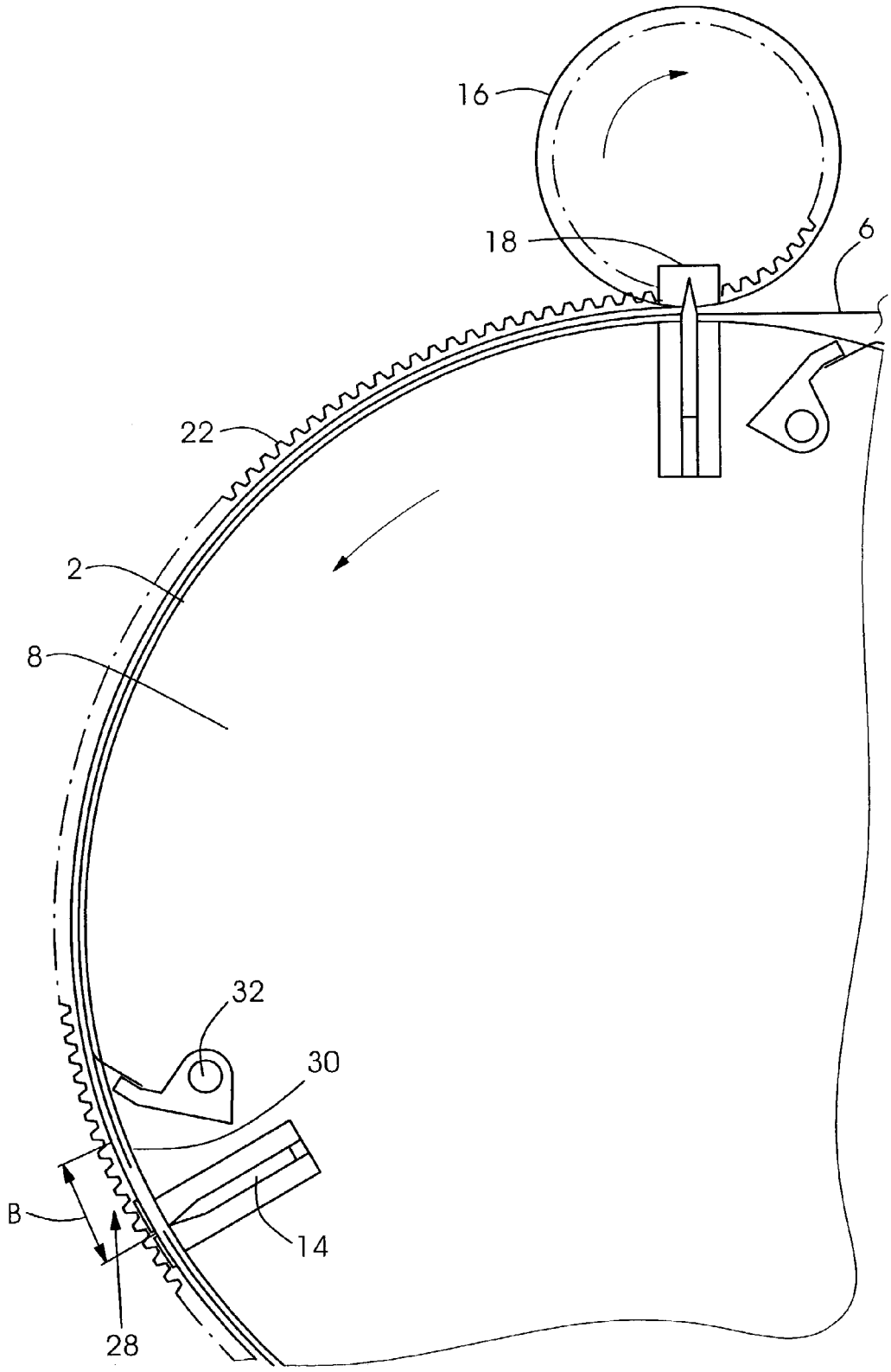
FIG. 2*a* is a schematic representation of a first embodiment during the cutting operation, in which a toothed belt extending around the anvil element and the folding blade cylinder is used.
Figure 2B:
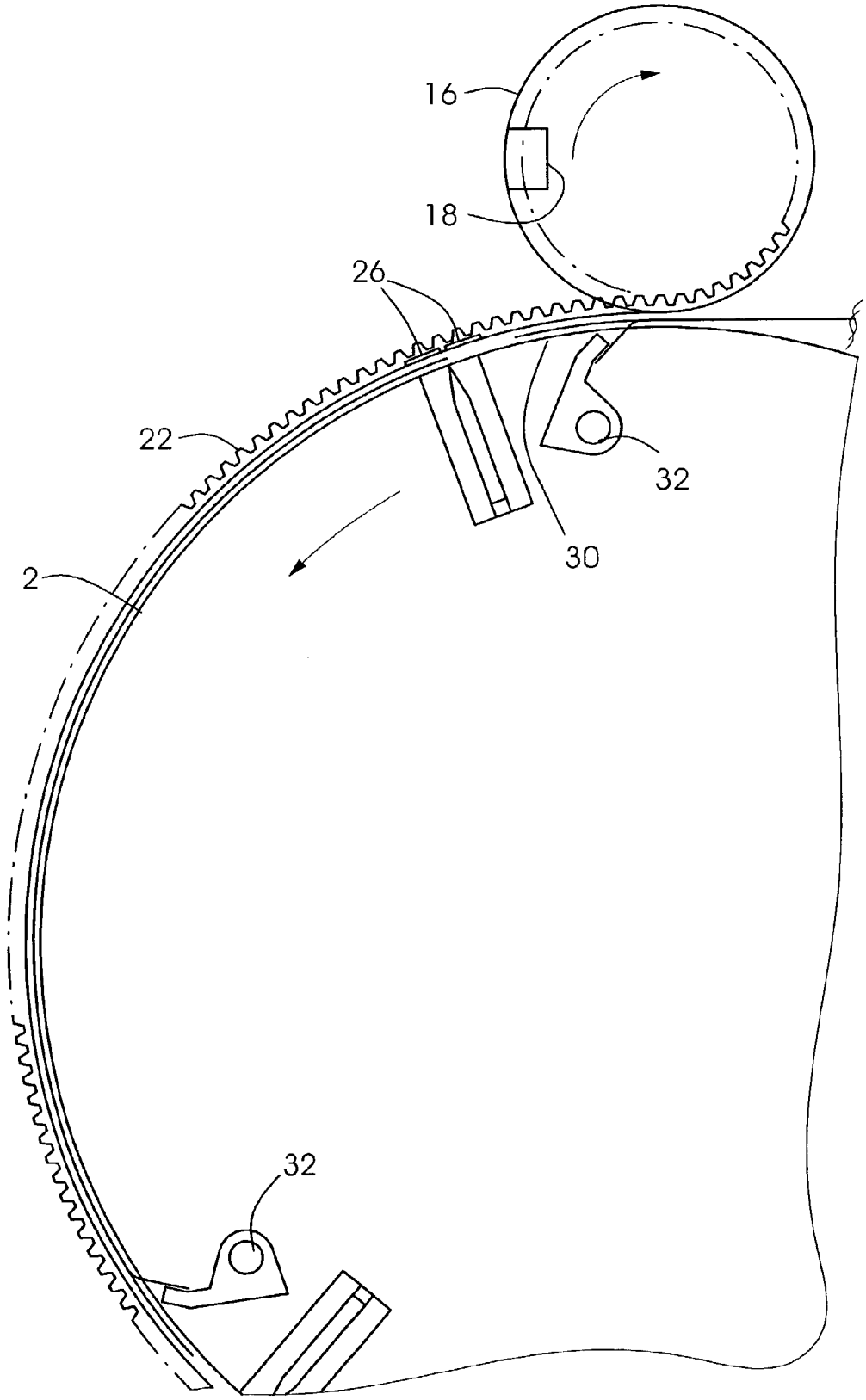
FIG. 2*b* depicts the embodiment of FIG. 2*a* upon further rotation of the folding blade cylinder and closure of the leading-edge gripping device to illustrate the gap that forms between the cutting element and the leading edge of the material web.

According to the embodiment of FIGS. 2*a*, 2*b*, and 4, the rotating conveying element can be formed of a toothed belt 22, which is passed around rotating anvil element 16 with its toothed side and, with its flat side, around folding blade cylinder 8, and which is driven via a toothing 24 (FIG. 4) in the peripheral surface of the rotating anvil element 16.

Figure 5:
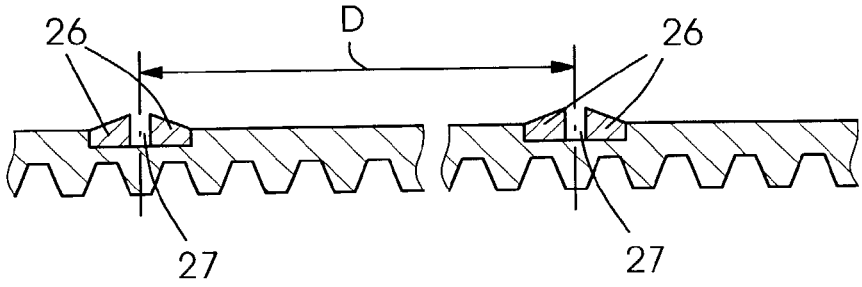
FIG. 5 is a cross-sectional view of a toothed belt having two reinforced sections arranged therein.

According to the representation of FIG. 5, toothed belt 22 is provided with reinforced sections or inserts 26 which have a cutting groove 27 into which cutting blade 14 plunges during the cutting operation. Reinforced sections 26 are spaced apart by a distance D which essentially corresponds to the length of signatures 2 plus the width B of a gap 28 which is formed between the leading edge 30 of material web 6 and cutting blade 14 of cutting device 4 in that folding blade cylinder 8 moves at a higher circumferential speed than toothed belt 22.

As can be seen from FIG. 2*a* in this context, in a first cylinder position, in which signature 2 is cut off from the web, a leading-edge gripping device 32 is actuated which plunges through gap 28 and grasps leading edge 30 of material web 6, that is, of signature 2 which is being produced or has been produced very shortly before. The signature held at leading edge 30 by leading-edge gripping device 32 is subsequently pushed in known manner by a folding blade of cylinder 8 into folding jaws of a downstream jaw cylinder (shown in FIG. 1, for example).

In this context, the speeds of folding blade cylinder 8 and band-shaped conveying element 12 or toothed belt 22 are selected, for example, in such a manner that, for example, after a quarter turn of cylinder 8, a gap 28 is formed which has a size, for example, between 1 cm and 5 cm.

Figure 6:
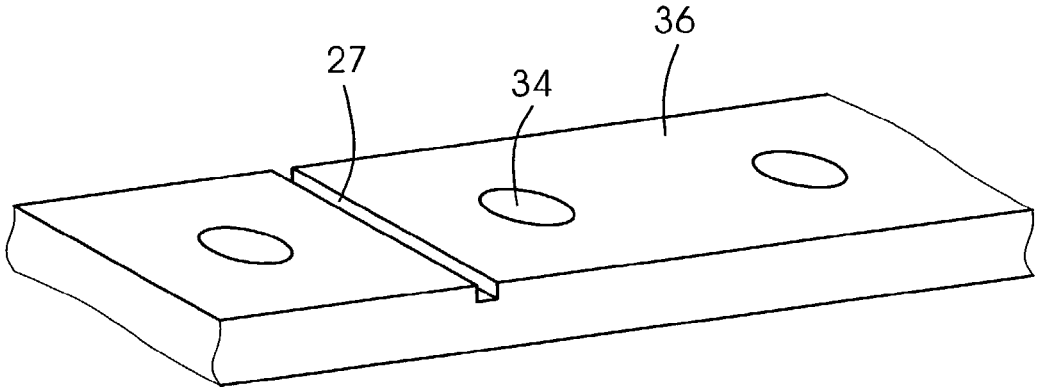
FIG. 6 shows a further embodiment of a band-shaped conveying element in which are formed a cutting groove formed as well as engagement openings for phase-accurate drive.

Moreover, as shown in FIG. 6, another band-shaped conveying element 36 provided with engagement openings 34, which can be designed, for example, as a metal band or Kevlar band preferably with a cutting groove 27 formed therein, and which is driven via peg-shaped engagement elements on rotating anvil element 16 that engage with engagement openings 34, can also be used in place of toothed belt 22.

Figure 7:
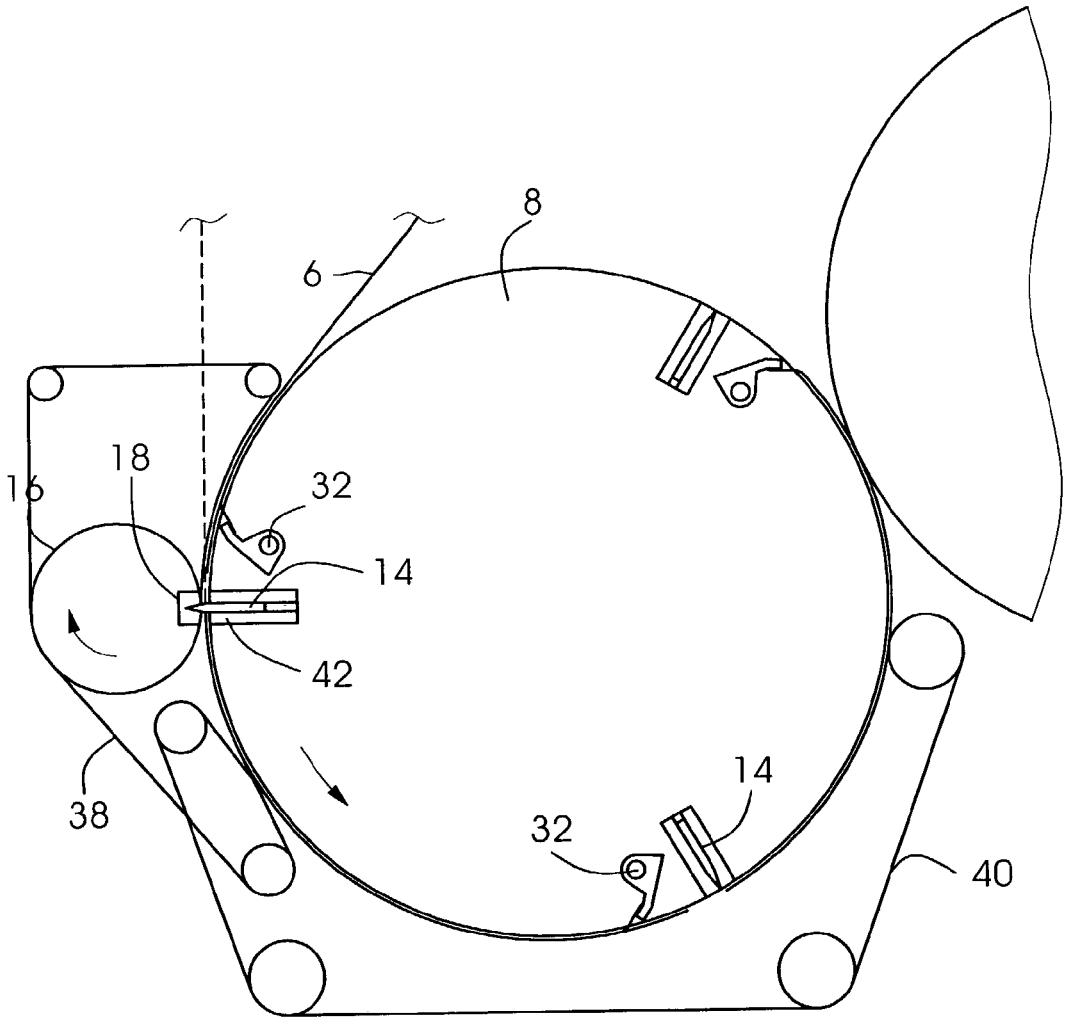

According to a further embodiment of the present invention shown in FIG. 7, the band-shaped rotating conveying element is designed as a preferably smooth-surfaced belt 38 which is manufactured from cut-resistant material and which has a further band-shaped conveying element 40 arranged downstream thereof in the direction of rotation of folding blade cylinder 8. In this context, belt 38 is passed around rotating anvil element 16 via not specifically referenced deflection pulleys in such a way that, with respect to the rotation center of folding blade cylinder 8, rotating band-shaped conveying element 38 is guided on and in contact with the perimeter of folding blade cylinder 8 over an angular range of 40° before the point of interaction of cutting blade 14 and anvil element 16, and that material web 6 is held between the peripheral surface of folding blade cylinder 8 and conveying element 38 over this range prior to the cutting operation.

The imaginary tangential infeed direction of the web is indicated in broken lines.

Figure 8A:
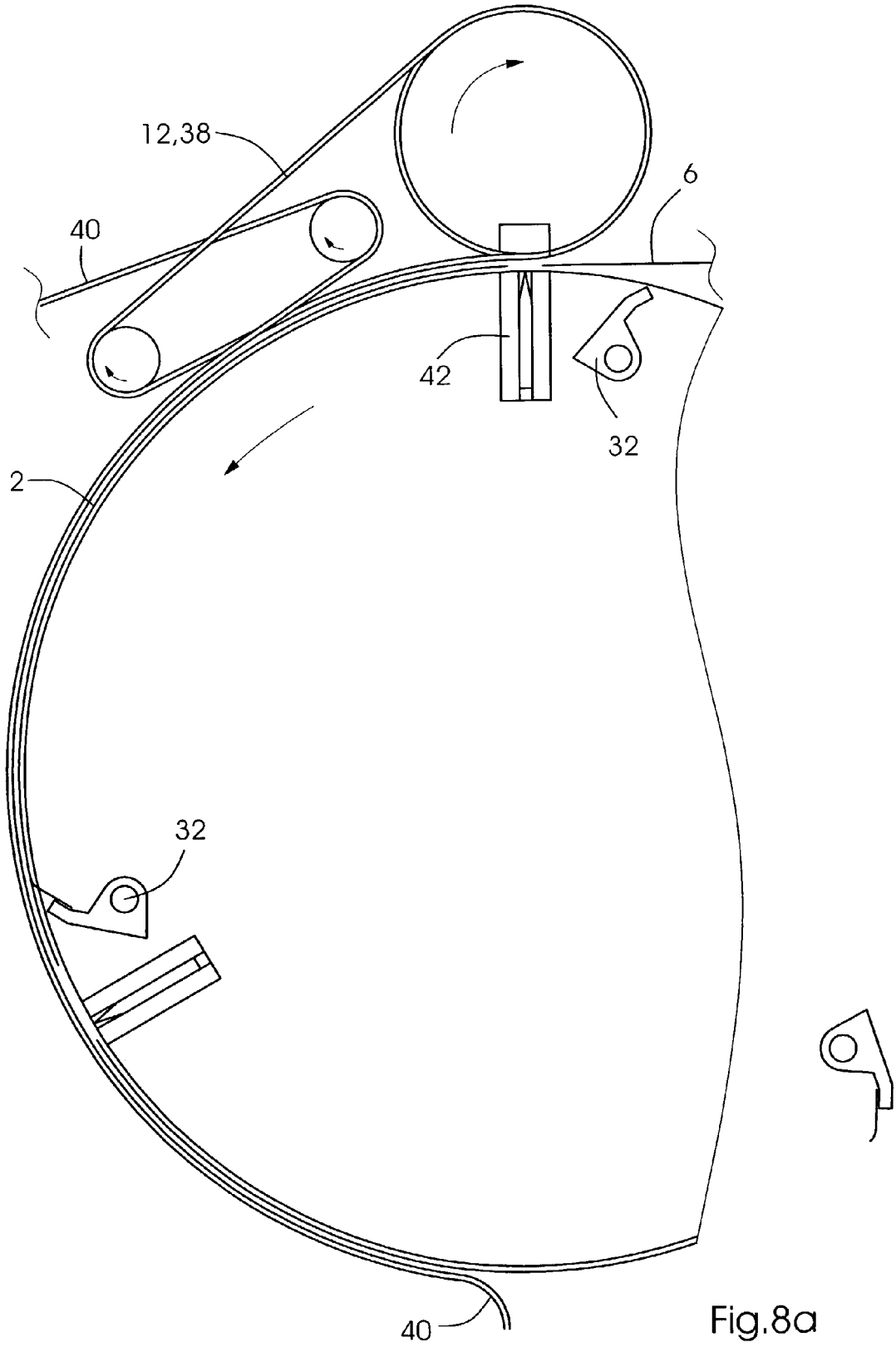
FIG. 8*a* is an enlarged detail view of the embodiment of FIG. 7 with the folding blade cylinder in a first position in which the cutting element interacts with the anvil element, cutting off a signature from the entering material web.
Figure 8B:
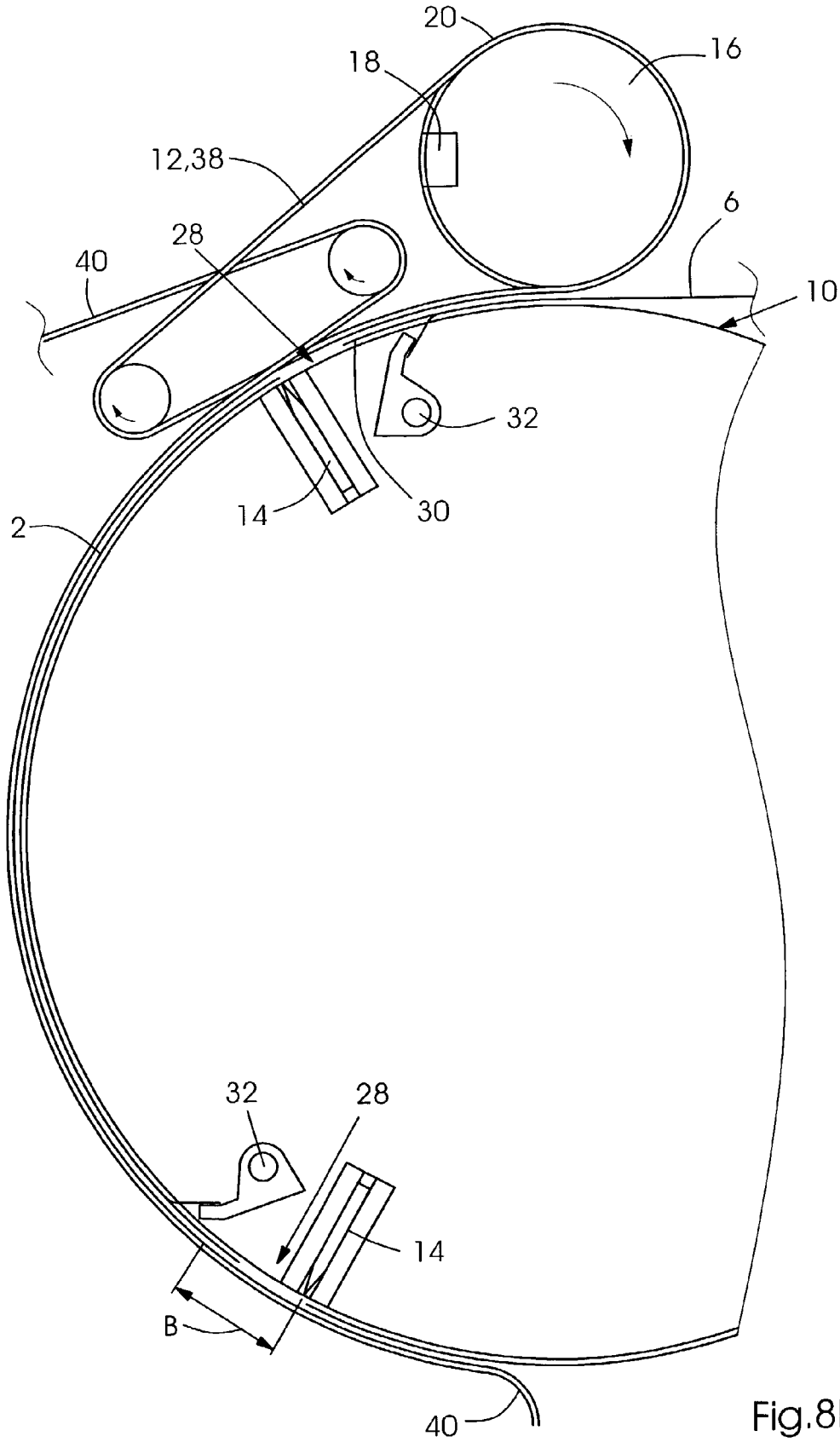
FIG. 8*b* depicts a further position of the embodiment of FIG. 8*a* upon further rotation of the folding blade cylinder and closure of the leading-edge gripping device to illustrate the forming gap.

In this context, similarly to further rotating conveying element 40, belt 38 preferably rotates at a reduced speed in relation to the speed of signature transport surface 10 of folding blade cylinder 8, as a result of which, similarly to the embodiment of FIGS. 2*a* and 2*b*, a gap 28 is formed between leading edge 30 of material web 6 and cutting blade 14, through which a leading-edge gripping device 32 grasps leading edge 30 upon further rotation of cylinder 8 according to the representation of FIGS. 8*a* and 8*b* and, in this manner, carries signature 2 at the speed of signature transport surface 10 of the cylinder after the cutting operation.

Similarly to toothed belt 22, belt 38 of cut-resistant material is also guided in a corresponding groove 20 which is formed on the perimeter of rotating anvil element 16.

Figure 11:
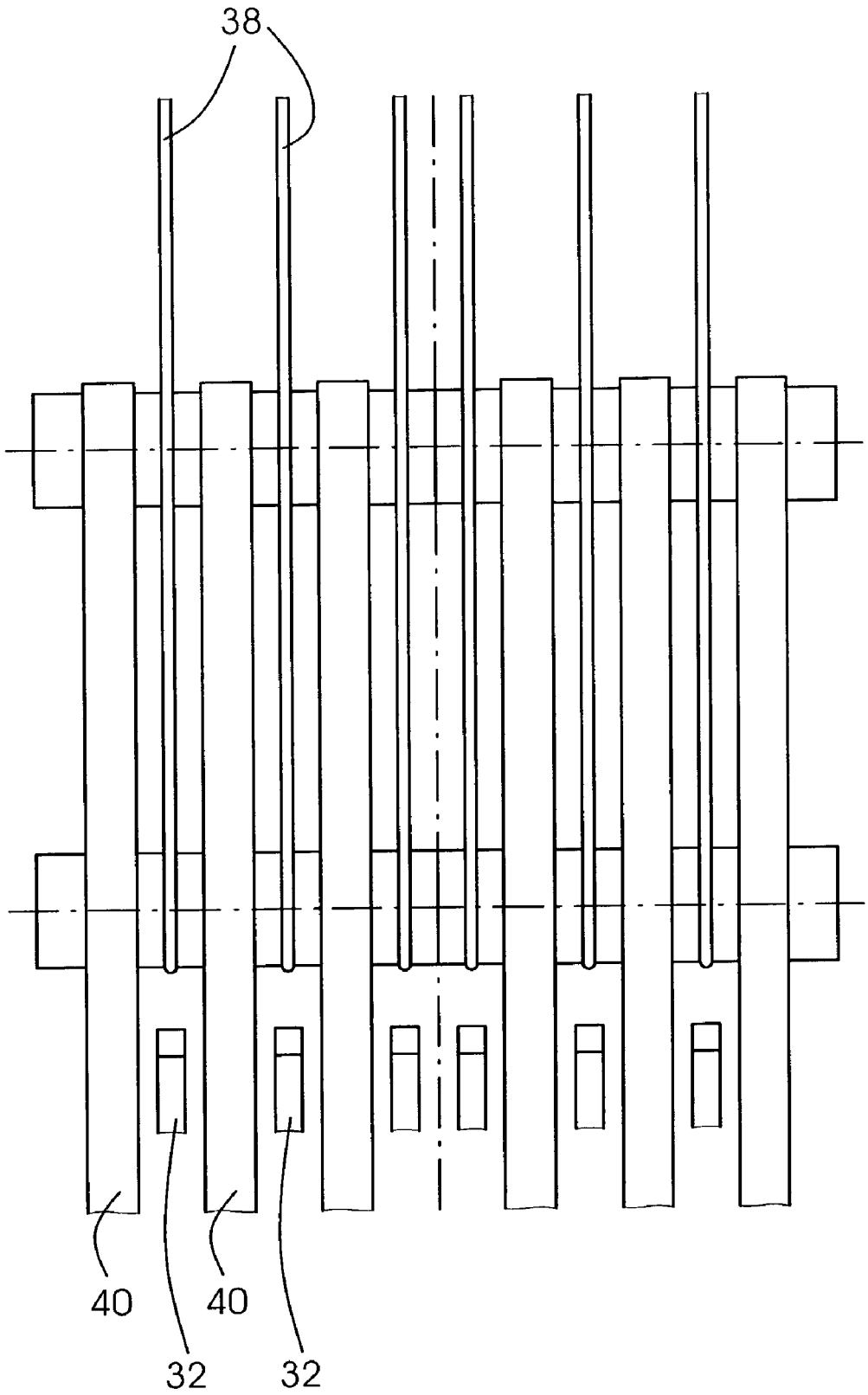
FIG. 11 is a top view of the embodiment of FIG. 7 to illustrate the arrangement of rotating conveying elements and, located therebetween, the gripper devices which are used for grasping the leading edge of the signatures.

As can be seen from the representation of FIG. 11, when using a plurality of belts of cut-resistant material 38 running side-by-side as well as a plurality of further rotating conveying elements arranged downstream, these are staggered relative to each other; leading-edge gripping devices 32 being advantageously arranged centrally between the downstream further conveying elements 40 at the locations situated at the height of belts 38.

Figure 9:
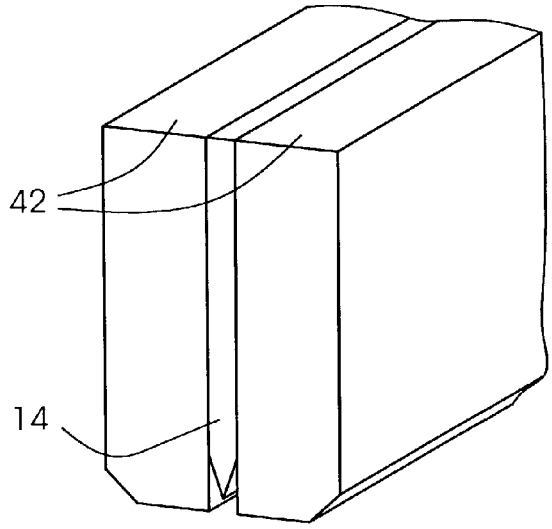
FIG. 9 is a schematic three-dimensional representation of a preferred embodiment of the cutting element which is encased with a protection and clamping device.
Figure 10:
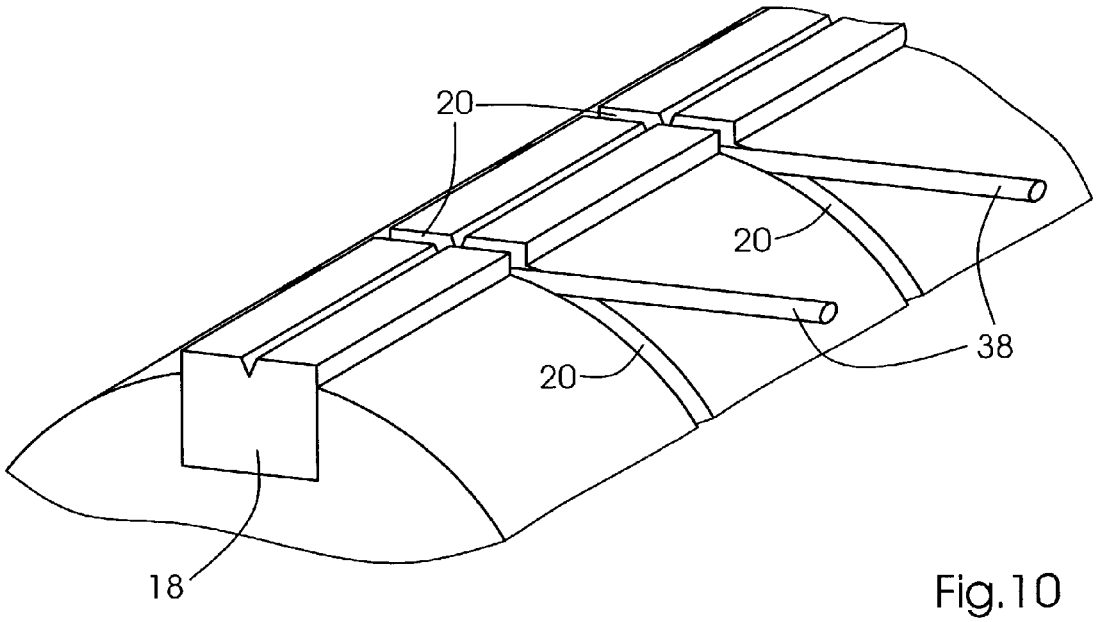
FIG. 10 is a schematic three-dimensional representation of the anvil element with the grooves formed therein in which are guided the smooth-surfaced, band-shaped conveying elements made of cut-resistant material.

Finally, FIG. 9 shows a preferred embodiment of cutting blade 14, which is laterally provided with a protection and clamping device 42 which is composed of rubber-elastic material, for example, of polyurethane. Protection and clamping device 42 serves, first of all, to protect against injuries by cutting blade 14, which is preferably fixedly mounted at the periphery of folding blade cylinder 8, and, secondly, ensures that the leading, newly forming cut edge of web 6 is pressed against rotating anvil element 16 and against rotating band-shaped conveying element 12, which acts as a counter-pressure element or supporting element, during the cutting operation.

LIST OF REFERENCE NUMERALS

1 folding apparatus
2 signature
4 cutting device
6 material web
8 folding blade cylinder
10 signature transport surface
12 rotating band-shaped conveying element
14 cutting blade
16 rotating anvil element
18 grooved strip
20 groove
22 toothed belt
24 toothing in the anvil element
26 reinforced section
27 cutting groove
28 gap
30 leading edge of the material web
32 leading-edge gripping device
34 engagement opening
36 metal band/Kevlar band
38 belt of cut-resistant material
40 further rotating band-shaped conveying element
42 protection and clamping device
D spacing of reinforced sections 26
B width of gap 28

What is claimed is:

1. A folding apparatus in a web-fed rotary printing press for folding signatures cut off from a running web of material comprising:

a cutting device;

at least one rotating band shaped conveying element; and a cylinder having a signature transport surface for carrying the signatures with the aid of the at least one rotating band-shaped conveying element around the cylinder;

the cutting device including a cutting blade arranged on the cylinder and a rotating anvil element interacting with the cutting blade;

the rotating band-shaped conveying element being passed around the rotating anvil element and acting as a counter-pressure element for the cutting blade during cutting of the signatures;

the band-shaped conveying element being a belt guided in a groove formed on the rotating anvil element, a death of the groove being smaller than a thickness of the band-shaped conveying element;

wherein the belt is a toothed belt provided with reinforced sections in regions where the cutting blade interacts with the belt during the cutting operation.

2. A folding apparatus in a web-fed rotary printing press for folding signatures cut off from a running web of material comprising:

a cutting device;

at least one rotating band shaped conveying element; and a cylinder having a signature transport surface for carrying the signatures with the aid of the at least one rotating band-shaped conveying element around the cylinder;

the cutting device including a cutting blade arranged on the cylinder and a rotating anvil element interacting with the cutting blade;

the rotating band-shaped conveying element being passed around the rotating anvil element and acting as a counter-pressure element for the cutting blade during cutting of the signatures;

the band-shaped conveying element being a belt guided in a groove formed on the rotating anvil element, a depth of the groove being smaller than a thickness of the band-shaped conveying element;

the belt being a toothed belt provided with reinforced sections in regions where the cutting blade interacts with the belt during the cutting operation;

wherein the toothed belt has a toothed side and a flat side and is passed around the rotating anvil element with the toothed side and around the cylinder with the flat side.

3. A folding apparatus in a web-fed rotary printing press for folding signatures cut off from a running web of material comprising:

a cutting device;

at least one rotating band shaped conveying element; and a cylinder having a signature transport surface for carrying the signatures with the aid of the at least one rotating band-shaped conveying element around the cylinder;

the cutting device including a cutting blade arranged on the cylinder and a rotating anvil element interacting with the cutting blade;

the rotating band-shaped conveying element being passed around the rotating anvil element and acting as a counter-pressure element for the cutting blade during cutting of the signatures;

the rotating conveying element rotating at a reduced speed in relation to the signature transport surface such that, as the rotation of the cylinder proceeds, a gap is formed between the cutting blade and a leading edge of the material web after the cutting operation;

wherein the cylinder includes a leading-edge gripping device grasping the leading edge of the signature severed from the material web through the gap.

4. A folding apparatus in a web-fed rotary printing press for folding signatures cut off from a running web of material comprising:

a cutting device;

a rotating band shaped conveying element;

a cylinder having a signature transport surface for carrying the signatures with the aid of the at least one rotating band-shaped conveying element around the cylinder; and a further rotating band-shaped conveying element downstream of the rotating band-shaped conveying element;

the cutting device including a cutting blade arranged on the cylinder and a rotating anvil element interacting with the cutting blade;

the rotating band-shaped conveying element being passed around the rotating anvil element and acting as a counter-pressure element for the cutting blade during cutting of the signatures;

wherein the rotating band-shaped conveying element is manufactured over its entire length from a material resistant to damage by the cutting blade, and the further rotating band-shaped conveying element is manufactured from a material not resistant to cuts from the cutting blade.

5. A folding apparatus in a web-fed rotary printing press for folding signatures cut off from a running web of material comprising:

a cutting device;

at least one rotating band shaped conveying element; and a cylinder having a signature transport surface for carrying the signatures with the aid of the at least one rotating band-shaped conveying element around the cylinder;

the cutting device including a cutting blade arranged on the cylinder and a rotating anvil element interacting with the cutting blade;

the rotating band-shaped conveying element being passed around the rotating anvil element and acting as a counter-pressure element for the cutting blade during cutting of the signatures;

wherein the rotating anvil element includes a cutting rubber element.

6. A folding apparatus in a web-fed rotary printing press for folding signatures cut off from a running web of material comprising:

a cutting device;

at least one rotating band shaped conveying element; and a cylinder having a signature transport surface for carrying the signatures with the aid of the at least one rotating band-shaped conveying element around the cylinder;

the cutting device including a cutting blade arranged on the cylinder and a rotating anvil element interacting with the cutting blade;

the rotating band-shaped conveying element being passed around the rotating anvil element and acting as a counter-pressure element for the cutting blade during cutting of the signatures;

wherein the rotating anvil element includes a grooved strip.

* * * * *

UNITED STATES PATENT AND TRADEMARK OFFICE

CERTIFICATE OF CORRECTION

PATENT NO. : 7,329,219 B2
APPLICATION NO. : 10/437576
DATED : February 12, 2008
INVENTOR(S) : Alain Blanchard et al.

It is certified that error appears in the above-identified patent and that said Letters Patent is hereby corrected as shown below:

Claim 1 in column 8, lines 50 to 51 should read: "the band-shaped conveying element being a belt guided in a groove formed on the rotating anvil element, a depth of the groove being smaller than a thickness of the"

Signed and Sealed this

Second Day of June, 2009

John Doll

JOHN DOLL
*Acting Director of the United States Patent and Trademark Office*